US010500453B1

(12) United States Patent
Carter

(10) Patent No.: US 10,500,453 B1
(45) Date of Patent: Dec. 10, 2019

(54) PUTTER FOR GOLF

(71) Applicant: Raymond Carter, Harrisburg, PA (US)

(72) Inventor: Raymond Carter, Harrisburg, PA (US)

( * ) Notice: Subject to any disclaimer, the term of this patent is extended or adjusted under 35 U.S.C. 154(b) by 0 days.

(21) Appl. No.: 16/502,237

(22) Filed: Jul. 3, 2019

Related U.S. Application Data

(60) Provisional application No. 62/712,273, filed on Jul. 31, 2018.

(51) Int. Cl.
*A63B 53/02* (2015.01)
*A63B 53/04* (2015.01)
*A63B 53/06* (2015.01)
*A63B 53/00* (2015.01)

(52) U.S. Cl.
CPC ..... *A63B 53/065* (2013.01); *A63B 53/007* (2013.01); *A63B 2053/0441* (2013.01)

(58) Field of Classification Search
USPC ..... 473/245–248, 306, 307, 313, 324–350
See application file for complete search history.

(56) References Cited

U.S. PATENT DOCUMENTS 1,535,707 A * 4/1925 Barnes ..... A63B 53/065 473/248
1,550,665 A * 8/1925 Barnes ..... A63B 53/06 473/248
1,657,972 A * 1/1928 Rowe ..... A63B 53/065 473/248
1,765,982 A * 6/1930 Keating ..... A63B 53/06 473/248
1,890,538 A * 12/1932 Hadden ..... A63B 53/02 473/306
2,155,830 A * 4/1939 Howard ..... A63B 53/06 473/246
2,464,850 A * 3/1949 Crawshaw ..... A63B 53/00 473/299
2,932,515 A * 4/1960 May ..... A63B 53/065 473/248
3,682,516 A * 8/1972 Savage ..... B25G 3/04 403/189
4,736,951 A * 4/1988 Grant ..... A63B 53/007 473/246
5,244,205 A * 9/1993 Melanson ..... A63B 53/065 473/248
5,308,063 A * 5/1994 Vendur ..... A63B 53/02 473/248
5,390,919 A * 2/1995 Stubbs ..... A63B 53/065 473/246
5,462,279 A * 10/1995 Culpepper ..... A63B 53/065 473/248
5,531,445 A * 7/1996 Levocz ..... A63B 53/02 473/341
5,533,730 A * 7/1996 Ruvang ..... A63B 53/02 473/251

(Continued)

*Primary Examiner* — Alvin A Hunter
(74) *Attorney, Agent, or Firm* — Hooker & Habib, P.C.

(57) ABSTRACT

A putter for golf has a putter head, a putter shaft, and a hosel removably attaching the putter shaft to a rear face of the putter head that is opposite from the impact face of the putter head. The hosel can selectively attach the putter shaft to the putter head for either left-hand or right-hand putting. The impact head of the putter face may be rectangularly shaped and have height and width dimensions greater than the diameter of a standard golf ball.

8 Claims, 5 Drawing Sheets

(56) References Cited

U.S. PATENT DOCUMENTS

| | | | | | |
|---|---|---|---|---|---|
| 5,580,051 | A * | 12/1996 | Fisher | A63B 53/02 | 473/248 |
| 5,863,257 | A * | 1/1999 | Busnardo | A63B 53/02 | 473/246 |
| 6,095,929 | A * | 8/2000 | Clark | A63B 60/00 | 473/248 |
| 6,142,884 | A * | 11/2000 | Yim | A63B 53/02 | 473/248 |
| 6,234,915 | B1 * | 5/2001 | Wu | A63B 53/02 | 473/248 |
| 6,371,866 | B1 * | 4/2002 | Rivera | A63B 53/00 | 473/288 |
| 6,435,976 | B1 * | 8/2002 | Galliers | A63B 53/02 | 473/244 |
| 6,475,097 | B2 * | 11/2002 | Liao | A63B 53/007 | 473/248 |
| 6,623,372 | B1 * | 9/2003 | Beebe | A63B 53/007 | 473/231 |
| 6,988,956 | B2 * | 1/2006 | Cover | A63B 53/065 | 473/244 |
| 7,207,897 | B2 * | 4/2007 | Burch | A63B 53/02 | 473/288 |
| 9,079,077 | B2 * | 7/2015 | Wolf | A63B 53/0487 | |
| 9,545,544 | B2 * | 1/2017 | Jones | A63B 53/007 | |
| 10,166,445 | B2 * | 1/2019 | Brandt | A63B 53/0487 | |
| 2003/0050132 | A1 * | 3/2003 | Wilbur | A63B 53/00 | 473/296 |

* cited by examiner

FIG.3
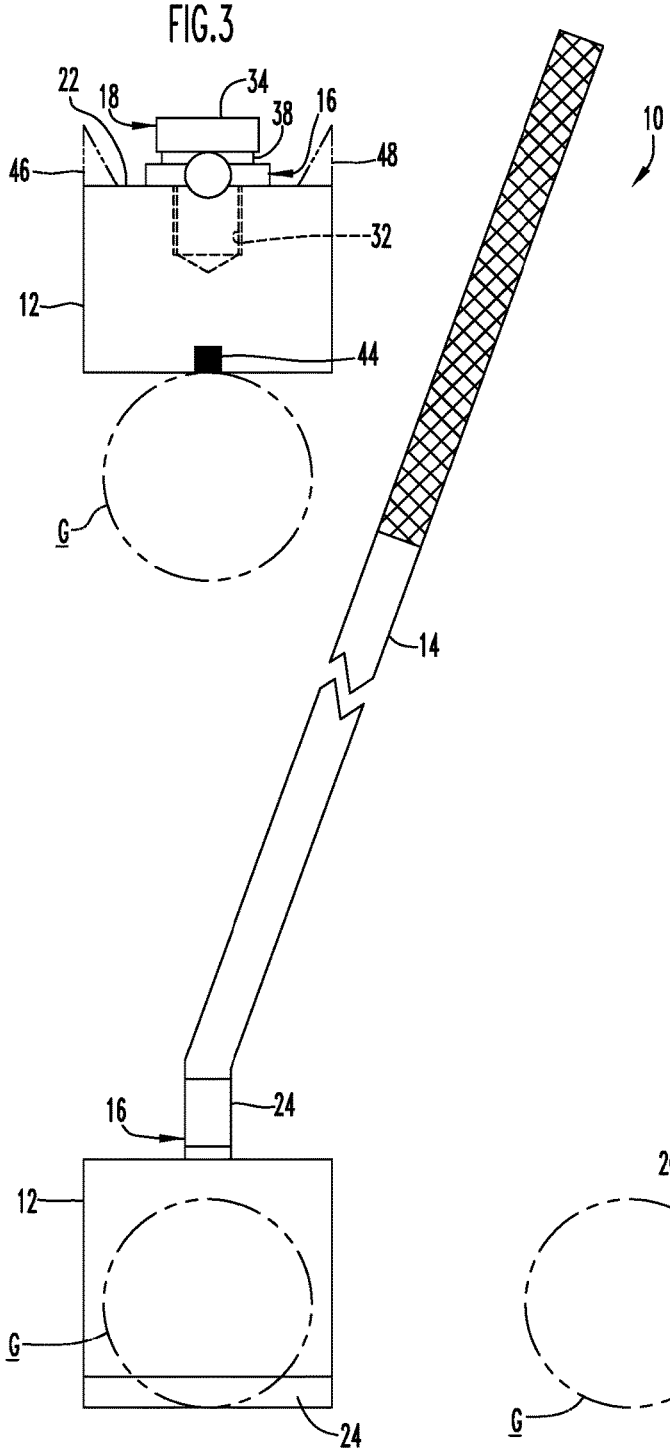
FIG. 1
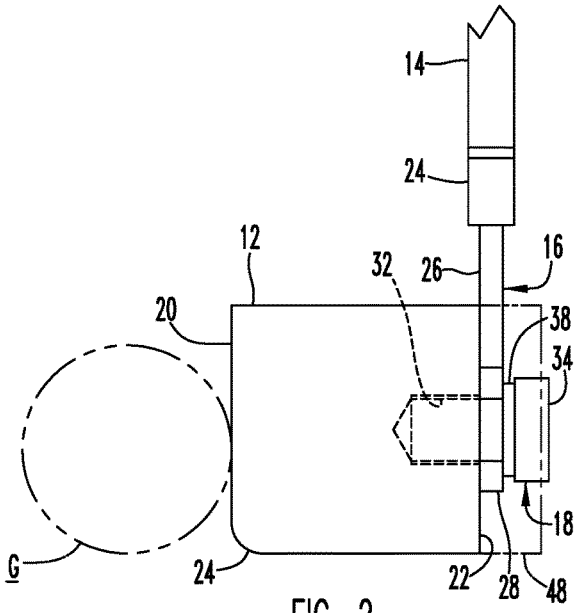
FIG. 2

PUTTER FOR GOLF

RELATED APPLICATION

This application claims the benefit of and priority to my U.S. Patent Application Ser. No. 62/712,273 "Putter" filed Jul. 31, 2018, which priority application is incorporated by reference as if fully set forth herein.

FIELD OF THE DISCLOSURE

The disclosure relates to a putter for golf.

BACKGROUND OF THE DISCLOSURE

Putters for golf have a putter head that impacts the golf ball and a putter shaft extending from the putter head to be gripped by the putter when moving the putter head. The putter shaft is normally inclined from the vertical when putting and so a putter is normally provided in one of two configurations: for right-hand use or for left-hand use.

Some putters can be converted between right-hand use and left-hand use. Other putters enable the lie angle of the putter shaft (the lie angle being the angle the putter shaft intersects the plane of the ground when putting on a flat surface) to be adjusted by the golfer.

However, there is always a need for an improved putter featuring simplified construction that enables converting between left-hand and right-hand use as well as enabling golfer adjustment of the lie angle.

SUMMARY OF THE DISCLOSURE

Disclosed is a putter for golf. Embodiments of the disclosed putter are convertible between left-hand and right-hand use, and the lie angle of the putter shaft can be finely adjusted by the golfer as well.

The lie angle of the putter shaft in some embodiments may have a relatively wide angle of adjustment that enables the putter to be converted between left-hand use and right-hand use without removing the putter shaft from the putter head.

The lie angle in some embodiments of the disclosed putter can also be set at essentially ninety degrees for sidesaddle or croquet style putting.

A putter in accordance with the disclosure has a putter head, an elongate putter shaft, a hosel attached to the putter shaft, and a fastening connection releasably fastening the hosel to the putter head. The putter head has an impact face that strikes the golf ball and an opposite rear face. The fastening connection fastens the hosel against the rear face of the putter head. The fastening connection enables the hosel to be selectively loosened from the putter head for conversion of the putter shaft between left-hand and right-hand putter configuration.

In an embodiment the fastening connection is a threaded connection releasably attaching the hosel to the rear face of the putter head. The threaded connection can be loosened in embodiments whereby the lie angle of the putter shaft can also be adjusted to fit the golfer's preference. The threaded connection also enables the putter shaft to be removed from the putter head and re-attached in the opposite hand (for example, from a left-handed putter to a right-handed putter). The threaded connection also enables the hosel to be loosened from the putter head for moving the putter shaft between left-hand and right-hand use without completely detaching the hosel from the putter head.

In another embodiment the fastener connection is a magnetic connection. The hosel or putter head includes a magnet that presses the hosel against the rear face of the putter head. The golfer can remove the hosel from the putter head and reattach for changing between left-hand and right-hand putting. The hosel and rear face of the putter head may have cooperating flat or spherical surfaces that enable the putter shaft to pivot about the putter head for changing between left-hand and right-hand putting or for adjustment of the lie angle while the magnet presses the hosel against the rear face.

In an embodiment the hosel includes a ferrule that attaches the putter shaft to the hosel and at least one rigid bar that extends from the ferrule to the putter head. The hosel may in embodiments include two bars that are pivotally connected together, one bar attached to the ferrule and the other bar attached to the putter head. The lie angle of the putter shaft can be adjusted by changing the relative angle between the two bars without loosening the bar attached to the putter head.

The putter head may be shaped as a rectangular or cuboid prism in which the impact face and the other faces of the putter head are each a rectangular face or substantially rectangular face. Some of the corners or edges of a face may be rounded or chamfered. In particular the lower edge of the impact face that is next to the putting surface when putting may be rounded or beveled to eliminate a sharp edge that might snag the putting surface.

The putter head is preferably made of steel or other relatively heavy metal.

The impact face in possible embodiments of the putter has a width and height greater than the diameter of a standard golf ball (1.680 inches [equal to 42.67 mm]). The impact face may be polished to the desired smoothness.

The top surface of the putter head may be marked or engraved with putting alignment aids that is visible to the golfer while lining up a putt with the putter. For example, a center mark can be provided along the common edge with the impact face to mark the center line of the impact head. The hosel may include markings that assist in adjusting and setting the lie angle of the putter shaft. The putter head may also include markings that cooperate with the hosel markings to set the lie angle of the putter shaft. The hosel bars of a multi-bar hosel embodiment may have cooperating markings for adjusting and setting the lie angle.

In a possible putter embodiment the impact face has a height and width of two inches (with the putter head resting on a flat putting surface the height dimension extends vertically away from the putting surface). The lower corners of the impact face that are adjacent the putting surface are rounded with a one-quarter inch radius chamfer. The thickness of the putting head is one=and-one-half inches.

The disclosed putter may convertible between left-hand and right-hand use. The threaded connection includes a tapped bore centered in the rear face of the putter head to receive a bolt extending through the hosel. The head of the bolt sandwiches the bar between the head and the rear face of the putter head. In another possible embodiment of the threaded connection a threaded shaft extends out from the rear face of the putter head and a nut threaded on the shaft sandwiches the hosel between the nut and the rear face of the putter head.

Alignment cues may be provided on the rear or top face of the putter head that assist the golfer in orienting the impact face along the desired putting line. For example, a pair of triangular wedges may extend outwardly from the rear face of the putter head to assist in alignment.

A single bar hosel or a multi-bar hosel may extend from the ferrule disposed at a shaft end of the hosel to a bar of the hosel disposed at an attachment end of the hosel. The bar at the attachment end may include a flat plate portion that may be generally circular in shape with a central through-hole to receive the bolt or threaded shaft of the threaded connection. A degrees-scale (similar to the markings on a protractor) can be provided on a surface of the plate that cooperates with marking or indicia on the putter head for establishing the lie angle of the putter shaft. Similar markings can be provided on the adjacent ends of a two-bar attachment structure for establishing the lie angle of the putter shaft.

A washer or lock washer can be used along the threaded connection to resist loosening of the assembled putter. The bolt head or nut may be configured for hand tightening of the bolt or nut. For example, the nut may be a wing nut.

The putter shaft can be oriented with respect to the putter head for either right-hand or left-hand use. The putter may be converted from one hand to the other hand by removing the hosel from the putter head, re-orienting the putter shaft, and re-attaching the hosel to the putter head.

Alignment structure on the rear face of the putter head for orienting the putter head along a putting line may also assist in locating the hosel relative to the putter head during assembly and may limit relative rotation of the hosel with respect to the putter head during assembly. An alignment structure extending from the putter head could also form a non-rotatable connection with the hosel that resists angular displacement of the hosel with respect to the putter head while putting or while handling the putter.

Other objects and features of the disclosed putter fir golf will become apparent as the description proceeds, especially when taken in conjunction with the accompanying drawing sheets illustrating one or more non-limiting embodiments.

BRIEF SUMMARY OF THE DRAWINGS

FIG. 1 is a front view of a putter for golf in accordance with the disclosure.

FIG. 2 is a side view of the putter head and attachment of the putter head to the putter shaft of the putter shown in FIG. 1.

FIG. 3 is a top view of the putter head and the attachment bar of the putter shown in FIG. 1.

DETAILED DESCRIPTION

Figure 4:
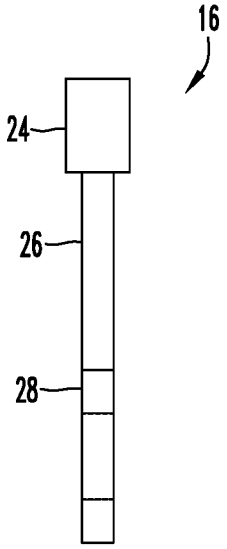
FIG. 4 is a side view of the attachment bar of the putter shown in FIG. 1.

FIGS. 1-3 show in whole or in part a first embodiment golf putter 10 in accordance with the disclosure. The putter includes a putter head 12, an elongate putter shaft 14, a hosel 16 connected to the putter shaft, and a threaded connection 18 attaching the hosel to the putter head. The putter shaft is conventional and includes a putter grip on the free end of the shaft. The putter shaft is only partially shown in FIGS. 1 and 2 and is omitted from FIG. 3. The putter is shown set up as a right-hand putter but is convertible to a left-hand putter as explained in more detail below.

The putter head 12 is shaped essentially as a rectangular prism having six rectangularly-shaped prism faces. The faces include an impact face 20 and an opposite rear face 22 parallel with and directly behind the impact face. The impact face is intended to impact the golf ball when putting. The height and width of the impact face are each two inches. The depth of the putter head between the input face and the rear face is one-and-one-half inches, A standard diameter golf ball G is shown in phantom in FIGS. 1-3 against the impact face 20 as if the ball were about to be struck by the putter head while putting. The golf ball is shown aligned with the bottom of the putter head 12 as if the golf ball is being putted on a flat putting surface. The lower edge 24 of the impact face 20 is rounded along its length to resist snagging of the putter head with the putting surface during the putting stroke.

Figure 5:
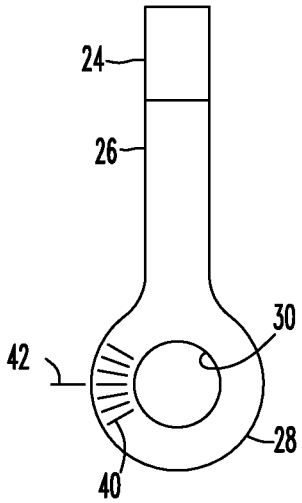
FIG. 5 is a rear view of the attachment bar shown in FIG. 4.

The hosel 16 is shown separately in FIGS. 4 and 5 as well as in FIGS. 1-3. The hosel includes a ferrule 24 disposed on a first end of the hosel and a rigid bar 26 attached to the ferrule that extends from the ferrule to an opposite second end of the hosel. The illustrated ferrule is a tubular member that receives the shaft within the interior the member. The ferrule can have open ends or can have a closed end. The bar is fixedly attached to the closed end or the outside of the tubular member.

The bar has a generally circular, radially enlarged end portion 28 that has a centered through hole 30.

Referring back to FIGS. 1-3, the threaded connection 18 removably attaches the bar end portion 28 against the putter rear face 22. The threaded connection includes a threaded blind hole 32 that opens into the putter head 12 from the rear face. The blind hole is centered on the rear face but in other embodiments could be located off-center with respect to the rear face. A bolt 34 extends through and is closely received in the bar hole 30 and is threaded into the threaded hole to sandwich the bar between the bolt head 36 and the rear face of the putter head. The bolt can be configured for hand tightening and/or for tightening by a tool such as a screw-driver, Allen wrench, or the like. An optional lock washer 38 is shown disposed between the bra and the bolt head to resist loosening of the tightened threaded connection.

The hosel 16 of the illustrated putter 10 is designed to extend upwardly perpendicular to the bottom face of the putter head. The manufacturer's preferred lie angle of the putter shaft is set by the bend formed in the putter shaft itself. However, the lie angle can be adjusted to the golfer's preference by tightening the threaded connection with the hosel bar inclined from the vertical as desired. To assist in setting the lie angle, the bar end portion 28 is provided with a set of radial marks or indicia 40 that cooperate with an indexing mark 42 located on the putter head rear face 22 to provide visual feedback of the angular orientation of the hosel with the putter head (see FIG. 5).

The putter head 12 is shown in FIGS. 1-3 being provided with putting alignment features that is visible to the golfer while lining up a putt with the putter 10. A centering mark 44 is visible on the top face of the putter. A first triangular wedge 46 and a second triangular wedge 48 extend along respective sides of the rear face. The hypotenuses of the wedges face each other. The wedges restrict the range of lie angle adjustment that can be achieved by angular displacement of the hosel with respect to the putter head. In possible embodiments the alignment aids or other locating structure on the putter head rear face 22 could form non-rotatable connections with the hosel that eliminates lie angle adjustment capability. Other alignment features or different alignment features could be provided.

To convert the putter 10 from one hand to the other hand, the bolt 34 is removed from the putter head 12 to separate the hosel 16 and the putter head, the hosel bar 36 is reversed against the putter head rear face 22, and the bolt is reattached to the putter head to clamp the hosel bar against the putter head. The now newly exposed side of the hosel bar can also include indicia (not shown) that cooperate with the putter head indicia 40 for setting the desired lie angle of the putter shaft with left-hand use.

Figure 6:
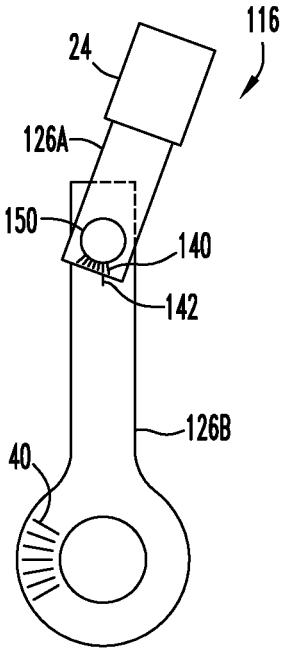
FIG. 6 is a rear view of a second embodiment two-bar attachment assembly for attaching the putter head to the putter shaft.
Figure 7:
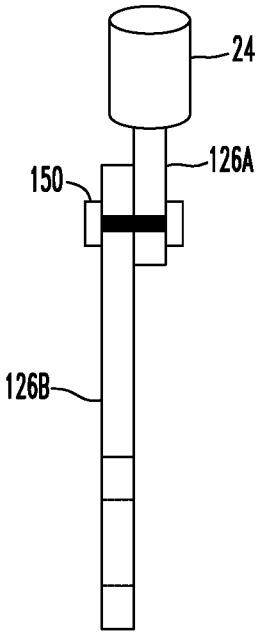
FIG. 7 is a side view of the two-bar attachment assembly shown in FIG. 6.

The putter shaft 14 shown in FIG. 1 has a bend that primarily establishes the lie angle of the putter shaft. FIGS. 6 and 7 illustrate a second embodiment hosel 116 that is preferably used with a straight putter shaft such as the putter shaft 214 shown in FIG. 8. The hosel includes a ferrule 124 like the ferrule 24 that is attached to a two-bar linkage. The two-bar linkage includes a first rigid bar 126A rigidly attached to the ferrule 118 and a second rigid bar 126B similar to the bar 26. The bars are pivotally connected by a clamp screw 150 that releasably clamps the two bars together and defines the pivot axis as shown. Loosening the clamp screw enables the lie angle of the putter shaft to be established without loosening or removing the hosel from the putter head. The bars can also be marked with indicia 140 on one bar and a cooperating index 142 similar to the indicia 40 and the indicia 42 to assist the golfer in setting the lie angle.

Figure 8:
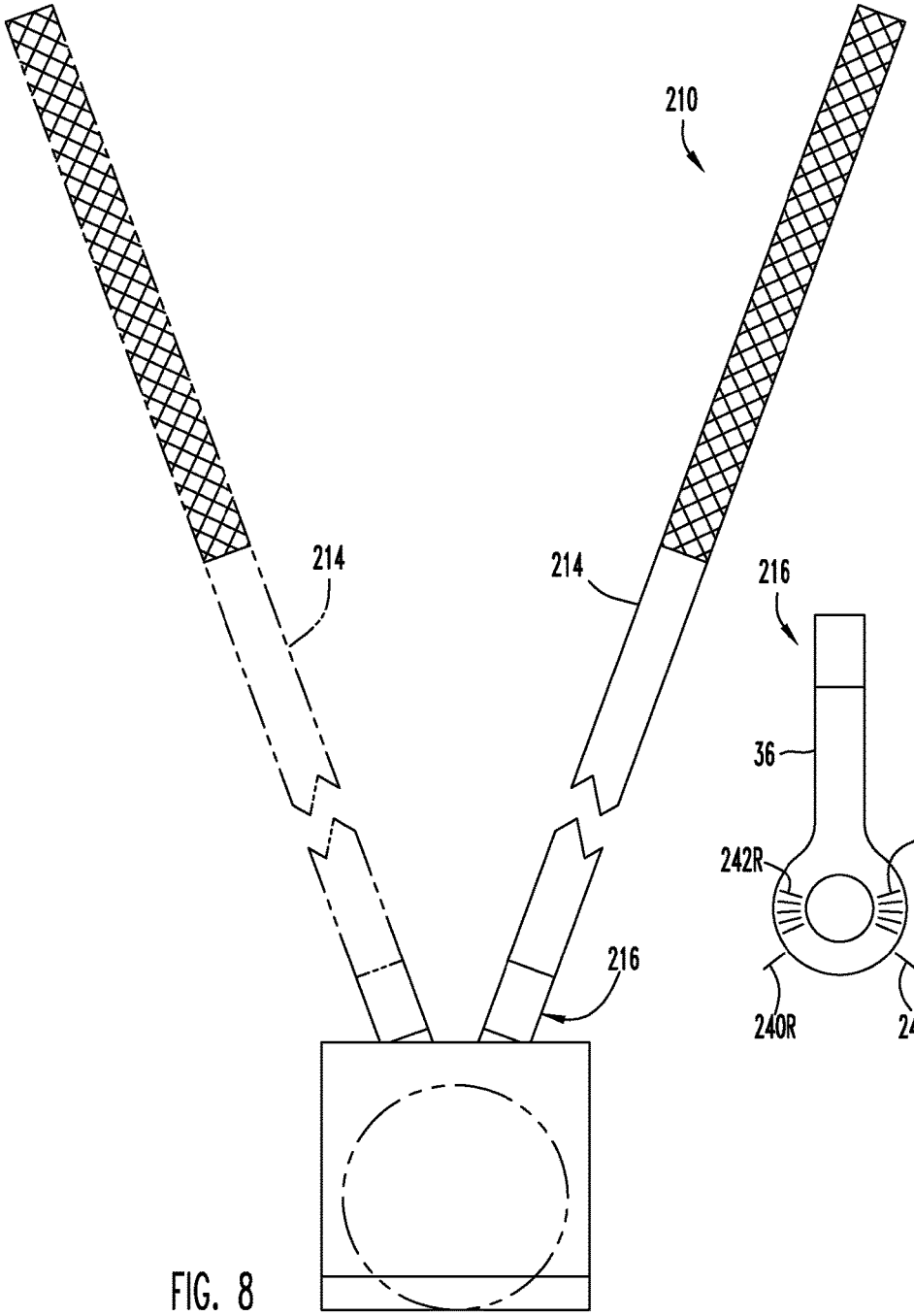
FIG. 8 is a front view of a second embodiment putter for golf.
Figure 9:
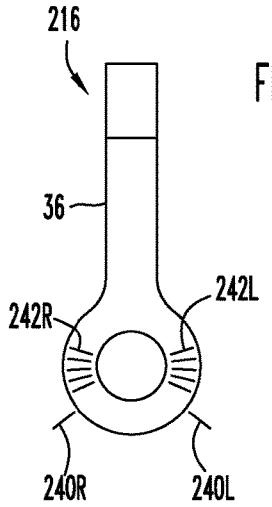
FIG. 9 is a rear view of the hosel of the putter shown in FIG. 8.

FIG. 8 is a front view of a second embodiment putter 210 and FIG. 9 is a front view of the hosel 216 of the putter 210. The putter 210 is similar to the putter 10 in having essentially the same putter head and the same fastener connection and so only difference will be discussed. The putter shaft 214 is a straight putter shaft that extends along a longitudinal axis for its entire length. The hosel 216 is essentially identical to the hosel 16 but the indicia is provisioned differently.

The putter shaft is convertible between right-hand use (the putter shaft shown in continuous lines in FIG. 8) and for left-hand use (the putter shaft shown in phantom lines in FIG. 8). Loosening the bolt 34 of the fastener connection 18 enables pivoting the hosel bar 36 of the hosel 216 about the bolt to position the putter shaft axis to the desired angular position with respect to the putter head for left-hand or right-hand use, and re-tightening the bolt fixes the putter shaft at the desired lie angle. The hosel bar 36 and the rear face of the putter head are provided with respective sets of indicia 240R, 240L and 242R, 243L for setting the lie angle or the putter shaft when positioned for either right-hand or left-hand use.

Figure 10:
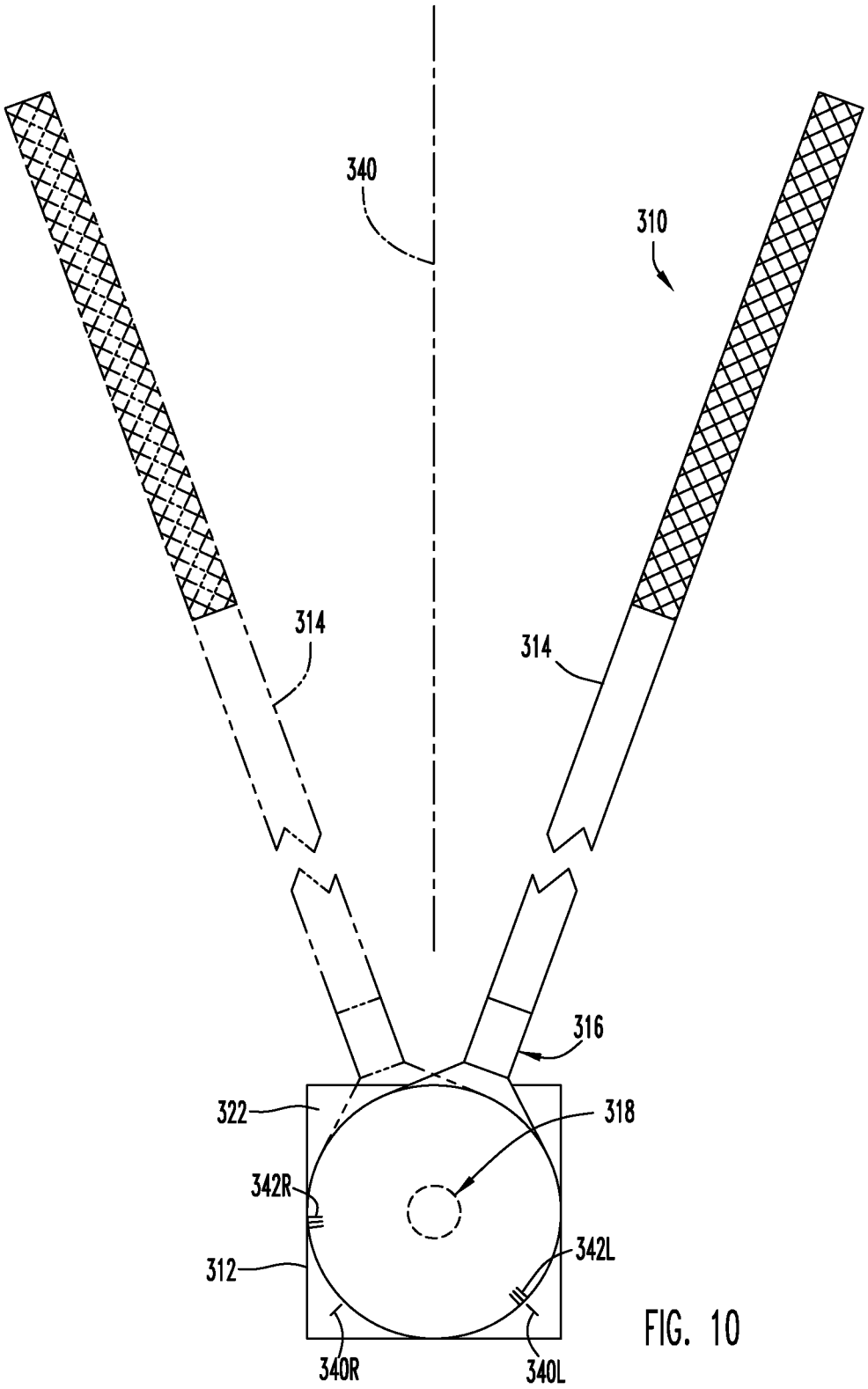
FIG. 10 is a rear view of a third embodiment putter for golf.
Figure 11:
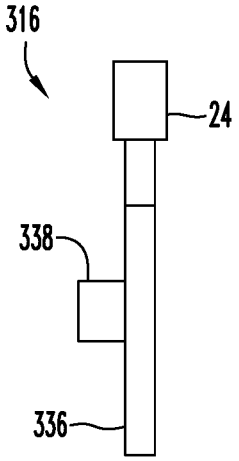
FIG. 11 is a side view of the hosel of the putter shown in FIG. 10.
Figure 12:
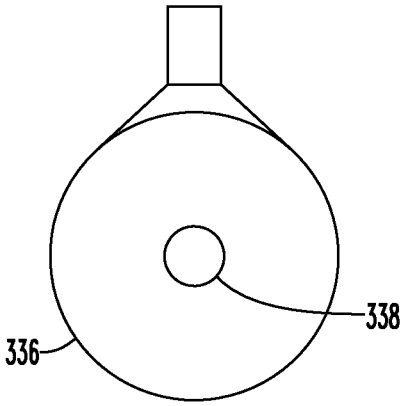
FIG. 12 is a rear view of the hosel shown in FIG. 11.
Figure 13:
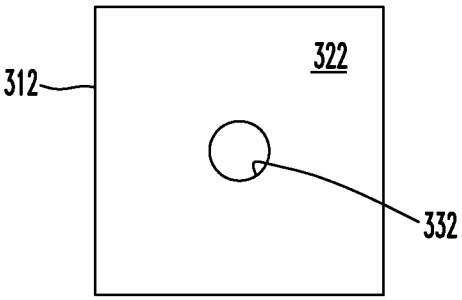
FIG. 13 is a rear view of the putter head of the putter shown in FIG. 10.

FIG. 10-13 illustrate a third embodiment putter 310. FIG. 10 is a rear view of the putter showing the putter shaft 314 in position for left-hand use (the putter shaft shown in sold lines in FIG. 10) and for right-hand use (the putter shaft shown in phantom lines in FIG. 10).

The putter 310 is similar to the putter 210 but the threaded fastener connection 18 releasably fastening the hosel to the putter head is replaced by a magnetic connection 318 that utilizes a magnet to fasten the hosel 316 the putter head rear face 322. No tools are required to remove the hosel from the putter head or to convert the putter between left-hand and right-hand use.

The magnetic connection 318 includes an unthreaded blind hole 332 disposed in the center of the putter rear face 322. The putter head 312 is made of steel.

The magnetic connection 318 also modifies the hosel 16 to form the hosel 316. The bar of the hosel 316 is made as a solid, flat magnetic plate 336 that is fixedly attached to the ferrule 24. In other embodiments the ferrule can be removably attached to the plate by screws, etc. for easy putter shaft replacement. A stub shaft 338 extends from one side of the plate is sized to be closely received in the putter head hole 332 and enables the magnetic force to press the flat plate 336 against the flat putter head rear face 322. The stub shaft cooperates with the wall of the putter head hole 332 to define a pivot axis that enables angular displacement of the putter shaft about the axis without removing the hosel from the putter head. The hosel plate 336 is shaped to not protrude from the bottom or sides of the putter when putting.

The stub shaft 338 is pivotable with respect to the putter head 313 to move the putter shaft 314 between the left-hand use position shown in solid lines and the right-hand use position shown in phantom lines in FIG. 10 without tools and without removing the stub shaft from the putter head. The putter shaft can assist in providing leverage for the golfer to overcome static and dynamic friction between the hosel plate and the putter head.

The putter shaft 314 can also be positioned to extend vertically along a vertical axis 340 for sidesaddle style or croquet style putting.

The hosel plate 336 and the putter head rear face 322 can include respective indicia 340L, 342L, 342V and 340R, 342R, 342V for setting the desired lie angle of the putter shaft. The hosel plate 336 can be made for less overlap with the rear putter face to provide space for alignment aids on the putter face rear face.

All the disclosed putter embodiments include the ability to have the putter shaft extend essentially at a lie angle of ninety degrees (that is, essentially vertical when putting on a horizontal surface) for sidesaddle or croquet style putting. Indicia in other embodiments can also be provided for indicating the putter shaft having a lie angle of ninety degrees.

The threaded connection 18 in an alternative embodiment include a threaded rod extending from the rear face of the putter head and a nut that threads onto the rod to sandwich the hosel between the nut and the putter head rear face.

While one or more embodiments have been disclosed and described in detail, it is understood that this is capable of modification and that the scope of the disclosure is not limited to the precise details set forth but includes modifications obvious to a person of ordinary skill in possession of this disclosure, including (but not limited to) changes in material selection, size, shape, or configuration and also such changes and alterations as fall within the purview of the following claims.

What is claimed is:

1. A putter for golf comprising:

a putter head, a putter shaft, a hosel, and a fastener connection releasably fastening the hosel to the putter head;

the putter head comprising an impact face and an opposite rear face;

the hosel attached to an end of the putter shaft, and the fastener connection removably fastening the hosel against the rear face of the putter head for putting whereby the putter is in a playing state when the hosel is fastened against the putter head; and the fastener connection being a magnetic connection comprising a magnet fastening the hosel to the putter head when the putter is in the playing state.

2. The putter of claim 1 wherein the hosel comprises the magnet.

3. The putter of claim 2 wherein the magnet is a magnetic plate comprising a flat surface that presses against the rear face of the putter head when the hosel is fastened to the putter head.

4. The putter of claim 3 wherein the magnetic connection comprises a shaft extending from the magnetic plate and received in a hole in the rear face of the putter head.

5. The putter of claim 1 wherein the impact face has a width dimension and a height dimension transverse to the width dimension, the height and width dimensions both being greater than 1.68 inches.

6. The putter of claim 1 wherein the impact face has a rounded or chamfered edge extending along a lower side of the impact face, the lower side being disposed adjacent to a putting surface during use of the putter to putt a golf ball.

7. The putter of claim 1 wherein the putter head includes one or more alignment features that assist in aligning the orientation of the putter with respect to a desired putting line when putting.

8. The putter of claim 1 wherein the hosel and the rear face of the putter head comprise cooperating visual indicia indicating the lie angle of the putter shaft when the putter is in the playing state.

* * * * *